US009125500B2

(12) United States Patent
Farrell

(10) Patent No.: US 9,125,500 B2
(45) Date of Patent: Sep. 8, 2015

(54) CRIB RAIL COVER

(71) Applicant: Ashleigh Farrell, Littleton, CO (US)

(72) Inventor: Ashleigh Farrell, Littleton, CO (US)

( * ) Notice: Subject to any disclaimer, the term of this patent is extended or adjusted under 35 U.S.C. 154(b) by 0 days.

(21) Appl. No.: 13/971,458

(22) Filed: Aug. 20, 2013

(65) Prior Publication Data

US 2015/0052684 A1 Feb. 26, 2015

Related U.S. Application Data

(60) Provisional application No. 61/691,252, filed on Aug. 20, 2012.

(51) Int. Cl.
*A47D 15/00* (2006.01)
*A61G 7/05* (2006.01)

(52) U.S. Cl.
CPC ..... *A47D 15/008* (2013.01); *A61G 2007/0522* (2013.01); *Y10S 5/946* (2013.01)

(58) Field of Classification Search
CPC ... A47D 15/00; A47D 15/008; A47D 15/005; A61G 2007/0522; Y10S 5/946
USPC ..... 5/424, 659
See application file for complete search history.

(56) References Cited

U.S. PATENT DOCUMENTS

| | | | | |
|---|---|---|---|---|
| 4,767,419 | A * | 8/1988 | Fattore | 5/659 |
| 5,535,457 | A * | 7/1996 | Welsh et al. | 5/93.1 |
| 5,566,407 | A * | 10/1996 | Lien | 5/93.1 |
| 5,642,545 | A * | 7/1997 | Howard | 5/663 |
| 5,678,260 | A * | 10/1997 | Belson | 5/93.1 |
| 5,881,408 | A * | 3/1999 | Bashista et al. | 5/663 |
| 7,003,823 | B1 * | 2/2006 | Reed et al. | 5/424 |
| 8,234,734 | B2 * | 8/2012 | Perry | 5/663 |
| 8,312,575 | B1 * | 11/2012 | Maraj | 5/93.1 |
| 8,689,379 | B2 * | 4/2014 | Cicci | 5/663 |
| 2006/0218726 | A1 * | 10/2006 | Waters et al. | 5/424 |
| 2009/0313762 | A1 * | 12/2009 | Boutwell | 5/663 |
| 2011/0041253 | A1 * | 2/2011 | Fiebrich et al. | 5/663 |
| 2012/0030879 | A1 * | 2/2012 | Waters et al. | 5/663 |

* cited by examiner

*Primary Examiner* — Peter M Cuomo
*Assistant Examiner* — Brittany Wilson
(74) *Attorney, Agent, or Firm* — Leyendecker & Lemire, LLC

(57) ABSTRACT

An article such as a crib rail cover that can protect an infant or young child from ingesting wood and toxins or from impact injury, and the crib from bite marks or other damage, is described. Embodiments of the crib rail cover comprises: a cover sleeve including top fabric portion and a backing portion, an inside padding portion, and a plurality of attachment structures. The crib rail cover is adapted to fit on various make and models of cribs.

14 Claims, 3 Drawing Sheets

CRIB RAIL COVER

RELATED APPLICATIONS

This application claims priority to provisional patent application no. 61/691,252 filed on Aug. 20, 2012 and having the same title and inventorship herewith.

FIELD OF THE INVENTION

The present invention relates generally to infant cribs. .

BACKGROUND

Infants and young children may sometimes chew or bite the rails (top edges) of their cribs while teething. Chewing and biting on the crib rails may cause the infant or young child to ingest wood, stain, varnish, plastic particles or other potentially harmful toxins. Additionally, an infant or young child may be injured while jumping or playing in the crib by hitting his/her head against the hard rail of the crib.

Cribs available on the market generally have standard dimensions (length and width or rails) and slat spacing.

DETAILED DESCRIPTION

Figure 1:
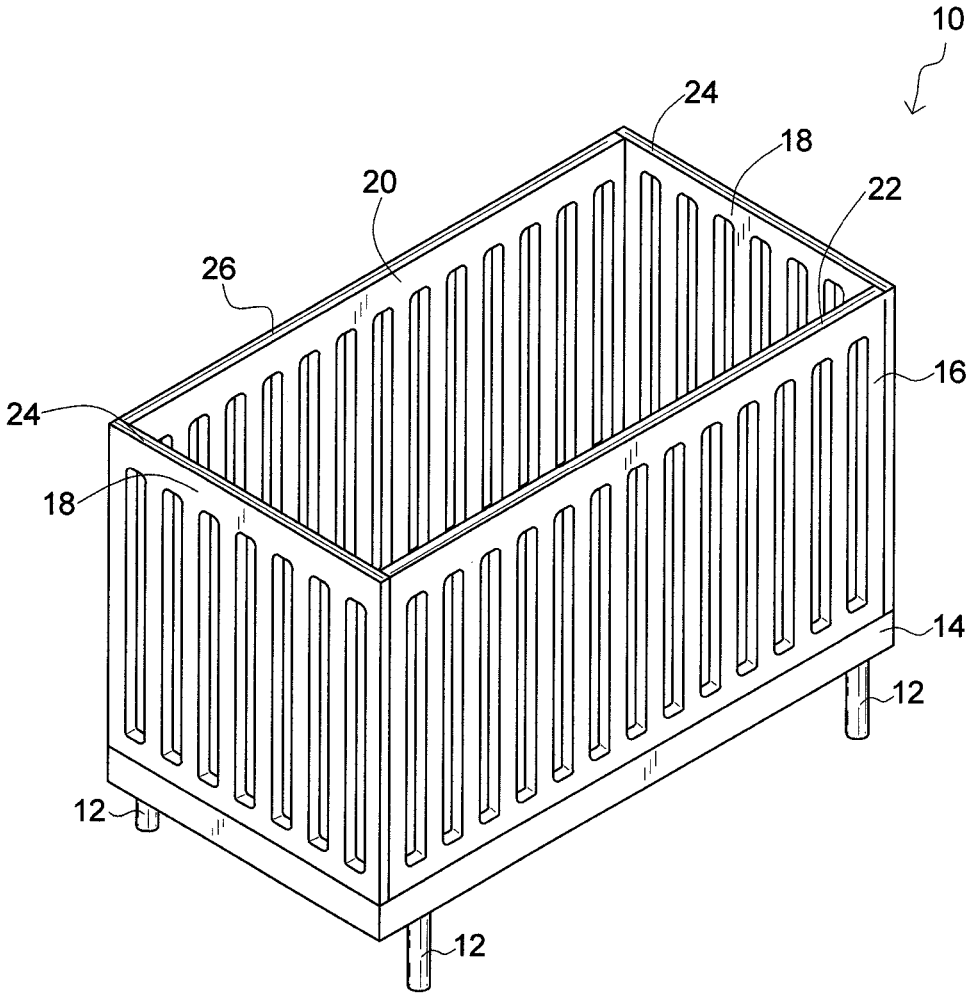
FIG. 1 PRIOR ART
FIG. 1 is a isometric view of a typical baby crib as is well known I the prior art.
Figure 2:
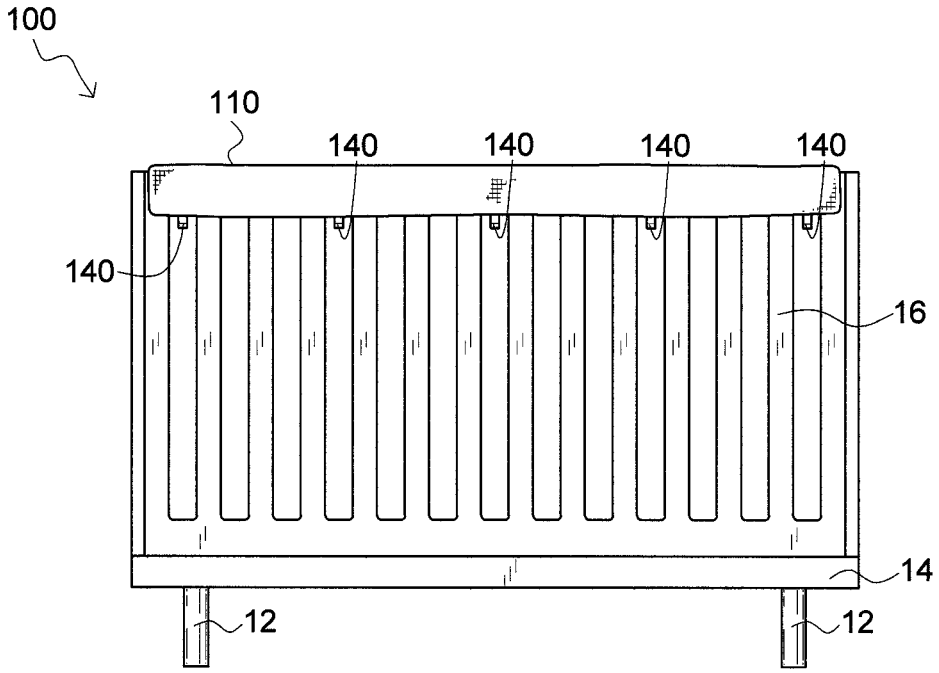
FIG. 2 is a front view of a crib having a crib rail cover installed on the visible front crib rail according to an embodiment of the present invention.

Embodiments of the present invention include a crib rail cover comprising a cover sleeve having a top portion and a backing portion, padding received in the sleeve and an attachment structure secured to the sleeve.

The sleeve is typically constructed from a high quality medium to heavy weight fabric, which may also be water-resistant or waterproof. In some variations the top and bottom (or backing) portions may comprise differing materials. For instance the backing portion can comprise a water proof or water resistant material that prevents moisture from a baby's saliva that has wicked from the top portion through the padding to damage the crib rail underneath the cover. The padding portion generally comprises multiple layers of polyester fleece, which resist the tendency of conventional padding materials, such as batting, to form bunches or lumps.

The attachment structure typically, but not necessarily, comprises a plurality of opposing cover tie pairs. Each cover tie is approximately 6 inches to 8 inches long and is typically sewn between the top and backing portions that form the cover sleeve. The length of the cover ties allow for double knotting in order to ensure secure attachment. Infant and young children can often remove a single knot, snaps, or other means of attachment. The cover tie is generally constructed from the same fabric used to construct the top portion of the crib rail cover, but may also be constructed using other materials such as, but not limited to: elastic ties, buttons, ribbons, and hook and loop structure material such as Velcro®.

Embodiments are configured to provide protection to an infant or young child from impact injuries resulting from jumping against, falling against, or otherwise striking crib structures. The device can furthermore protect an infant or child from exposure to crib materials due to chewing or biting a crib rail, and protects the crib rail from marring or other damage resulting from chewing or biting.

Embodiments furthermore offer a more aesthetic means of protection than provided by rubber or plastic rail covers especially since the cover material especially on the top portion can be imprinted with visually pleasing indicia.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment," "an embodiment," "another embodiment," "a preferred embodiment," "an alternative embodiment," "one variation," "a variation," and similar phrases mean that a particular feature, structure, or characteristic described in connection with the embodiment or variation, is included in at least an embodiment or variation of the invention. The phrase "in one embodiment," "in one variation." or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "fabric weight" means the density of a textile fabric measured as the number of ounces per square yard.

The term "fleece," as used in this specification and appended claims, refers to a soft napped woven fabric typically made from synthetic fibers. Fleece typically, but not necessarily, comprises polyethylene terephthalate (PET) or other polyester.

The terms "water-resistant" or "water-repellant," as used in this specification and appended claims, means resistant but not entirely impervious to penetration by water.

The term "waterproof," as used in this specification and appended claims, means impervious to penetration by water.

The term "organic cotton," as used in this specification and appended claims, refers to cotton from non-genetically modified plants that are grown without the use of synthetic agricultural chemicals such as fertilizers or pesticides.

The term "foam," as used in this specification and appended claims, refers to material in a lightweight cellular form resulting from introduction of gas bubbles during manufacture. Foam can be either open or closed-cell, and typically comprises polyurethane or polyethylene.

A First Embodiment Crib Rail Cover

A typical crib is shown in FIG. 1. It comprises a base 14 configured to support a crib mattress. The base is elevated off of a floor by way of legs 12. A front side 16, a rear side 20 and left and right sides 18 extend upwardly from the base to create the crib's interior volume. The top edges of the respective sides 22, 24 & 26 are often referred to as crib rails. In many instances, the top edges include strips of wood or other material that are wider than the underlying sidewall, and cap the thinner sidewall edge. These wider rails, which are often also rounded, mitigate but not fully eliminate the potential effects of a child's head or other body parts impacting the top edges of the crib. The crib rails are typically made of wood or a hard plastic.

A first embodiment crib rail cover article 100 is illustrated in FIGS. 2-5. The first embodiment crib rail cover article comprises a fabric sleeve and cover 110 including top and backing portions 114 & 130, an inside padding portion 120 and an attachment structures 140.

The fabric cover 110 of the first embodiment typically comprises top and bottom portions that are sewn together at seams to form a sleeve. The top portion is often comprised of a woven cotton fabric. In variations the top portion can be constructed from woven or non-woven fabric, which may be natural, synthetic, or a blend, and can comprise materials including but not limited to: organic or non-organic cotton, calico, cotton blends; wool; corduroy; denim; flannel; silk; hemp; linen; terry cloth; felt; burlap; microfiber; polyester; nylon; rayon; or acrylics. Organic cotton may be desirable in order to reduce exposure to pesticide residue or other potentially harmful substances, or to reduce the environmental footprint of the crib rail cover. Embodiments typically include woven cotton fabric comprising a relatively high thread count (>100 threads per inch (tpi)) single ply, long staple organic cotton yarn. Such top portions are usually softer and less abrasive than fabrics made from other types of cotton yarn in lower thread counts, which can be more appropriate when coming into contact with an infant or young child's skin.

The backing portion 130 also typically, but not necessarily, comprises woven cotton fabric. Embodiments can be constructed from materials such as, but not limited to: high quality medium to heavy weight fabric, oilcloth, canvas, rubber, or ballistic nylon. In some variations the fabric may have a water-resistant or waterproof coating applied to it to prevent or minimize the transfer of any moisture, such as from a child's saliva to the crib rail.

The inside padding portion 120 is typically comprised of multiple layers of fleece. The layers may be simply stacked or in some variations they are sewn or otherwise joined together to prevent potential shifting or folding of particular layers. In yet other variations the padding may also be sewn or otherwise secured to the fabric cover. The padding helps protect against impact injury to an infant or young child if they hit their head or other body part against the crib rail. Other embodiments may use materials such as, but not limited to, felt or foam. It is further appreciated that hybrid padding portions are also contemplated that use combinations of different padding materials, such as fleece and foam The top 114 and backing portions 130 are sewn typically together at the seams illustrated in FIG. 4. Other attachment means include, but are not limited to: quilting, glue, snaps, buttons, zippers, hook and loop structures such as Velcro®, and equivalent structures.

Figure 4:
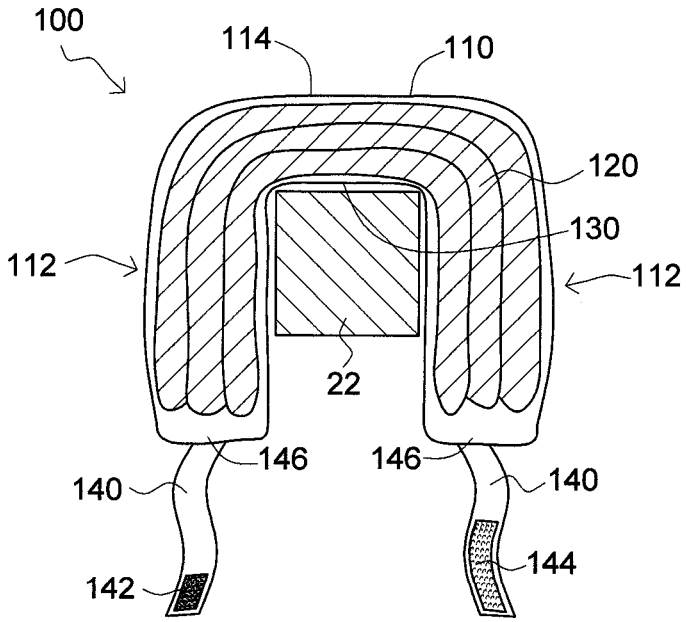
FIG. 4 is a cross-section view of a crib rail cover taken along line 4-4 of FIG. 3 according to an embodiment of the present invention.

The attachment structure used to secure the crib rail cover to the crib is typically, but not necessarily, a plurality of cover tie pairs 140. Each cover tie comprises a strap that is preferably between 5 inches and 10 inches long, more preferably between 6 inches and 9 inches long, and most preferably between 6 inches and 8 inches long. The width of the strap varies as well from a thin cord to several inches across. It is to be appreciated that wider straps can be preferred as they are less easily put into the mouth of a baby by the baby. In other embodiments attachment structures may include, but are not limited to: elastic ties, buttons, ribbons, hook and loop structures such as Velcro® (as shown in FIG. 4 with opposing straps having hook and loop mater 142 & 144 secured thereto). The ties are typically sewn to the cover 110 at spaced locations along the seams. The number of cover tie pairs used in a cover can vary depending on the length of the cover itself. For example, covers intended for the left and right sides may only have three pairs; whereas, covers intended for the front and back sides may include 5 or more pairs.

The crib rail cover 100 may also be reversible, with both the top portion 114 and backing portion 130 are constructed from coordinating or contrasting high quality medium to heavy weight fabric and either portion can serve as the top or bottom portion.

For the standard crib rail covers 100, the front rail cover typically has dimensions of 52 inches×10 inches. The side rail covers typically have dimensions of 27 inches×10 inches. Crib rail covers may also be customized, either in length or width, to fit non-standard size cribs.

Figure 5:
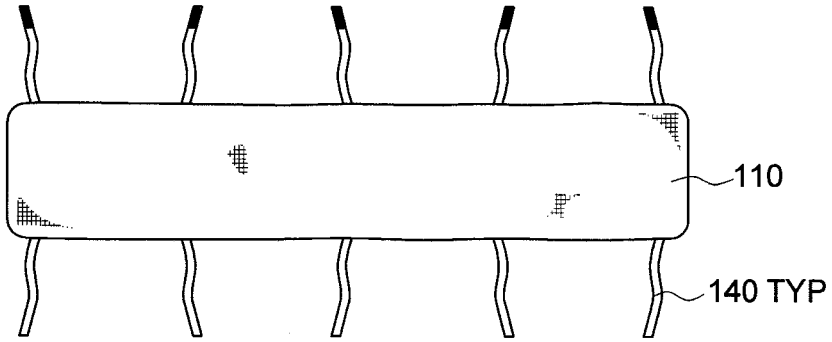
FIG. 5 is a top view of a crib rail cover prior to installation on a crib according to an embodiment of the present invention.
Figure 3:
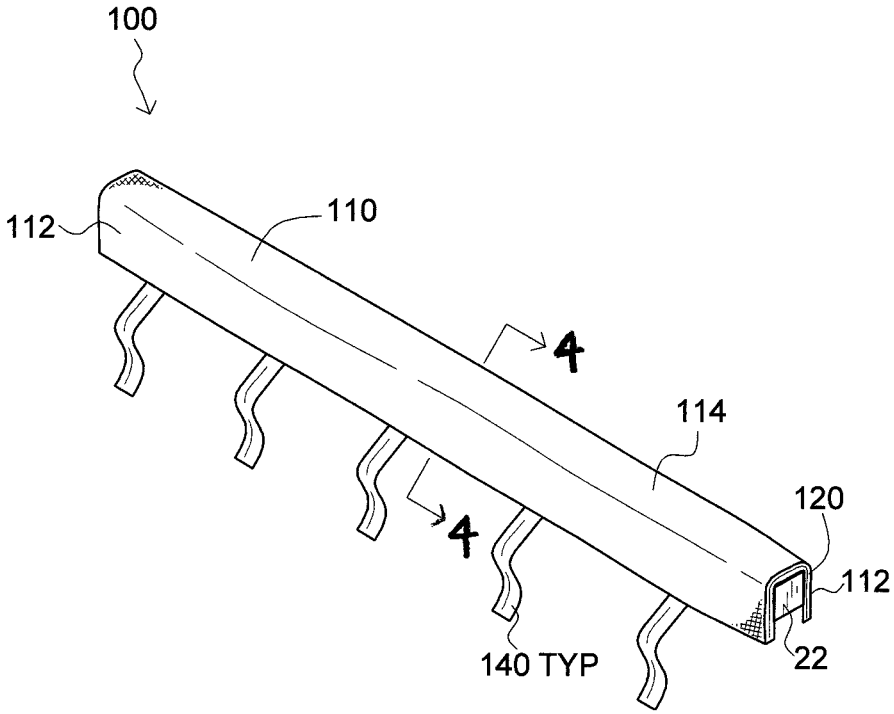
FIG. 3 is an isometric view of a crib rail cover received over a top rail of the crib according to an embodiment of the present invention.

A typically crib cover 100 in an uninstalled configuration is illustrated in FIG. 5. As shown the crib cover is generally flat and rectangular with opposing straps of the strap pairs being distributed along the lengthwise edges thereof. In contrast when installed on a crib rail, the cover is folded over to form left and right sides 112 that cover the left and right edges of the crib rail and extend downwardly a short distance over the respective crib side. The cover tie pairs 140 extend downwardly from the bottom edges of the left and right sides.

In use, the crib rail cover is placed over and centered on the desired rail with the top portion 114 facing upwardly and the bottom portion 130 being in contact with the associated crib rail. Next, at least one strap of a cover tie pair is fed through a slat in the cribs side. The opposing strap are tied together most often with a double knot. The process is repeated for each of the remaining cover tie pairs. Crib rail covers are then installed over the crib rails of the remaining three sides.

A Second Embodiment Crib Rail Cover with Attachments for Toys

A second embodiment crib rail cover article typically incorporates elements of the first embodiment crib rail cover. A tab is typically attached to the top portion 114 of the crib rail cover to allow teething or other baby toys to be attached to the crib rail cover. Typically, a bottom end of the tab is sewn to the top portion, while a tab top end is detachable. Examples of a detachable coupling by which the tab top end is attached to the top portion include, but are not limited to: snaps, buttons, or hook and loop structures such as Velcro®. In some embodiments, a tab is sewn or detachably coupled to a crib rail cover backing portion 130. In some embodiments, the bottom end of the tab may be sewn in between the top and backing portion, while the top end of the tab is detachable.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A crib rail cover comprising:

a cover sleeve having a top portion and a bottom portion, the top and bottom portions being substantially comprised of fabric materials;

a padding portion received inside the sleeve, wherein the padding portion is selected from the group consisting of multiple layers of fleece sewn together and a unitary piece of fleece folded upon itself; and a plurality of tie strap pairs distributed along a length of the cover sleeve;

wherein the bottom portion is configured to be located proximate a crib rail when installed on a crib and the top portion is located above the bottom portion away from the crib rail;

wherein the bottom portion is comprised of one of a water resistant and waterproof fabric material.

2. The crib rail cover of claim 1, wherein the top portion comprises of a first fabric material, the first fabric material consisting essentially of cotton.

3. The crib rail cover of claim 2, wherein the cotton is organic cotton.

4. The crib rail cover of claim 1, wherein the top portion is comprised of a first fabric material and the bottom portion is comprised of a second fabric material different from the first fabric material, the second fabric material being one of water resistant and waterproof.

5. The crib rail cover of claim 1, wherein each strap of each tie strap pair is between 6 inches and 8 inches long.

6. The crib rail cover of claim 2, wherein the tie strap pairs comprise the first fabric material.

7. The crib rail cover of claim 1, wherein each strap of each tie strap pair includes a patch of one of a hook material and a loop material.

8. The crib rail cover of claim 1, wherein each tie strap pair includes a button.

9. The crib rail cover of claim 1, wherein each tie strap pair includes a snap.

10. A crib rail cover comprising:

a cover sleeve having a top portion and a bottom portion, the top portion being substantially comprised of a cotton fabric, the bottom portion being comprised of one of a water resistant and waterproof fabric material, the top and bottom portions being sewn together at first and second seams to form the sleeve;

a padding portion received inside the sleeve, the padding portion comprising layered fleece material selected from the group consisting of multiple layers of fleece sewn together and a unitary piece of fleece folded upon itself; and a plurality of tie strap pairs distributed along a length of the cover sleeve, one strap from each pair being located and attached to the cover sleeve at the first seam and the other strap of each pair being located opposite the one strap and attached to the cover sleeve at the second seam, the tie strap pairs being comprised of the cotton fabric;

wherein the bottom portion is configured to be located proximate a crib rail when installed on a crib and the top portion is located above the bottom portion away from the crib rail.

11. The crib rail cover of claim 10, wherein the cotton fabric comprises organic cotton.

12. The crib rail cover of claim 11, wherein the organic cotton fabric comprises long staple yarn.

13. The crib rail cover of claim 12, wherein the thread count of the organic cotton fabric exceeds 100 threads per inch.

14. A crib rail cover consisting essentially of:

a cover sleeve having a top portion and a bottom portion, the top portion consisting essentially of a cotton fabric, the bottom portion consisting essentially of one of a water resistant and waterproof fabric material, the top and bottom portions being sewn together at first and second seams to form the sleeve;

a padding portion received inside the sleeve, the padding portion consisting essentially of a layered fleece material selected from the group consisting of multiple layers of fleece sewn together and a unitary piece of fleece folded upon itself; and a plurality of tie strap pairs distributed along a length of the cover sleeve, one strap from each pair being located and attached to the cover sleeve at the first seam and the other strap of each pair being located opposite the one strap and attached to the cover sleeve at the second seam, the tie strap pairs consisting essentially of the cotton fabric;

wherein the bottom portion contacts a crib rail when installed on a crib and the top portion is located above the bottom portion away from the crib rail.

* * * * *